United States Patent [19]

Michel

[11] Patent Number: 4,845,732

[45] Date of Patent: Jul. 4, 1989

[54] APPARATUS AND PROCESS FOR THE PRODUCTION OF BREMSSTRAHLUNG FROM ACCELERATED ELECTRONS

[76] Inventor: Roche Michel, 12 Rue de Saulx Tavannes, 21000 Dijon, France

[21] Appl. No.: 13,058

[22] Filed: Feb. 10, 1987

[30] Foreign Application Priority Data

Feb. 17, 1986 [FR] France ..... 86 02104

[51] Int. Cl.[4] ..... H05H 11/00

[52] U.S. Cl. ..... 378/119; 378/125; 378/144

[58] Field of Search ..... 378/119, 125, 130, 144; 328/237

[56] References Cited

U.S. PATENT DOCUMENTS

| | | | |
|---|---|---|---|
| 2,335,014 | 11/1943 | Kerst | 378/119 |
| 2,533,859 | 12/1950 | Wideröe | 328/237 |
| 2,803,766 | 8/1957 | Hebb | 328/237 |
| 3,149,257 | 9/1964 | Wintermute | 378/144 |
| 3,373,325 | 3/1968 | Sipek et al. | 328/237 |
| 3,975,689 | 8/1976 | Geizer et al. | 328/237 |
| 4,165,472 | 8/1979 | Wittry | 378/130 |

FOREIGN PATENT DOCUMENTS 83399 7/1983 European Pat. Off. .

OTHER PUBLICATIONS

Kerst, D. W., "The Acceleration of Electrons by Magnetic Induction, "*Physical Review*, vol. 60, 1941, pp. 47–53.

Westendorp, "The Use of Direct Current in Induction Electron Accelerators,"*Jour. Appl. Phys.* pp. 657–660.

Odell, R. C., "The Betatron Today, Part One of Two Parts," *Allis-Chalmers Electrical Review*, 1950, 3rd Quarter, pp. 13–17.

Goryachev et al., "Bremsstrahlung from a Thin Target of a Betatron," vol. 22 (1979) No. 4, Jul./Aug. Plenum Publishing Co., N.Y. pp. 922–927.

*Primary Examiner*—Carolyn E. Fields
*Assistant Examiner*—David P. Porta
*Attorney, Agent, or Firm*—Kerkam, Stowell, Kondracki & Clarke

[57] ABSTRACT

The invention relates to an apparatus and to a process for producing bremsstrahlung. This apparatus comprises in a ferromagnetic member a circular cavity containing electrons rotated on a circular path under the action of a magnetic field induced by the ferromagnetic member and by means for inducing a magnetic field. The apparatus also comprises a circular target partly located outside the cavity and rotating in a plane perpendicular to that of the path of the electrons. The end of the target periodically traverses said path in order to interact periodically with the electrons on their path, so as to produce bremsstrahlung. Means are provided for varying the magnetic field in the cavity and are synchronized with the interaction period of the target on the electrons and are connected to the induction means.

Application to all fields requiring the production bremsstrahlung.

17 Claims, 6 Drawing Sheets

FIG. 3
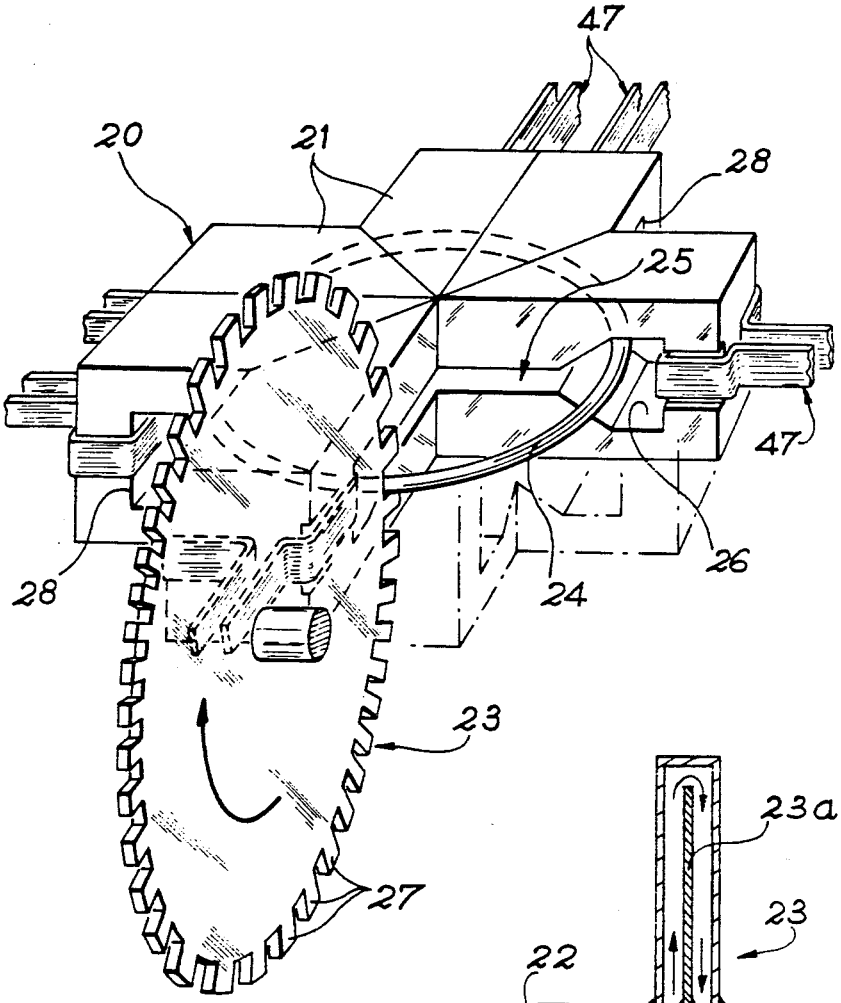
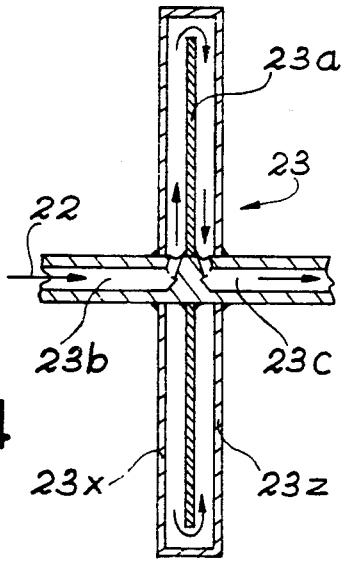
FIG. 4

APPARATUS AND PROCESS FOR THE PRODUCTION OF BREMSSTRAHLUNG FROM ACCELERATED ELECTRONS

BACKGROUND OF THE INVENTION

The present invention relates to an apparatus and to a process for the production of bremsstrahlung (braking radiation) from acceleration electrons.

The present invention relates to all fields requiring the production of bremsstrahlung, such as $\gamma$ or X-radiation. The invention more particularly applies to the field of physics, biological and medical research, the detection of faults in materials and the irradiation of food or industrial products.

FIG. 1 diagrammatically shows in section the structure of a betatron or electron accelerator. It comprises a ferromagnetic part 1 having two separate facing portions 3, 4 corresponding to the North and South poles of the part, a solenoid 5 in the centre of the part connecting the two portions 3 and 4 and a toroidal cavity 7 under vacuum in the median plane of the part. This cavity contains the electrons conventionally produced from an electron source, such as a filament or a plasma introduced into the cavity. There is a mgnetic field $\vec{B}$ perpendicular to the median plane between the two separate portions of the part.

The electrons present in the cavity, under the effect of the magnetic field $\vec{B}$, are rotated in accordance with a circular trajectory or path 9 of radius R in a plane perpendicular to the magnetic field direction. This radius R is a function of the electron velocity V and the intensity of the magnetic induction B, in accordance with the euation $R=mv/(eB)$, in which e represents the charge of the electrons and m their mass.

In order to accelerate the electrons, which initially have a low velocity, the magnetic induction intensity is increased. Thus, when the magnetic induction beam increases, the radius R of the path remains fixed and the velocity v of the electrons increases $$\left(v(t) = \frac{Re}{m} \cdot B(t)\right).$$

The rise in the magnetic induction is dependent on the voltage applied to the terminals of solenoid 5, the higher the voltage the higher the induced field.

The electrons accelerated in a betatron are particularly used for the study of matter. For focusing the beam of electrons, a toroidal coil to whose terminals a voltage is applied, can be introduced into the cavity in such a way that the electron beam traverses said coil. This type of betatron is generally called a "modified betatron" and is e.g. described by N Rostoker, of the University of California in the publication "Comments on plasm physics", 1980, vol 6, No. 2, pp 91–100.

Due to the presence of the magnetic field, the accelerated electron beam cannot be easily extracted from the betatron for use for producing radiation by the interaction of these electrons with a target.

In known manner, a target is directly introduced into the cavity containing the electrons in order to produce bremsstrahlung in the betatron. As bremsstrahlung is not sensitive to the magnetic field induced in the cavity, the latter can consequently escape from the betatron and be used.

FIG. 2 diagrammatically shows the interaction of electrons with a target placed on the circular path of these electrons. Thus, FIG. 2 shows the circular path 10 of electrons $\bar{e}$ rotated by a magnetic field B perpendicular to the plane of said path. A target 11 is placed on the path of the electrons to interact therewith.

The electron-target interaction leads to the emission of bremsstrahlung 12, which is substantially tangential to the circular path of the electrons. The bremsstrahlung is insensitive to the presence of the magnetic field, so that it not made to travel on a circular path.

An apparatus using a target placed on the circular path of accelerated electrons for producing bremsstrahlung is e.g. described in U.S. Pat. No. 2,335,014.

In an apparatus of this type, the target used and which rotates in a plane perpendicular to that of the electron path, is entirely disposed within the cavity containing the accelerated electrons. Thus, the target has a limited length and the latter is in particular less than the diameter of the path of the electrons.

A target of this type does not make it possible to produce high power radiation, i.e. of a few kW, as is more particularly used in the industrial irradiation field.

SUMMARY OF THE INVENTION

The present invention relates to an apparatus for producing bremsstrahlung from acceleration electrons making it possible to obviate this disadvantage and in particular produce bremsstrahlung of several kW.

More specifically, the present invention relates to an apparatus for producing bremsstrahlung having in a ferromagnetic member a circular cavity containing electrons rotated on a circular path under the action of a magnetic field induced by the ferromagnetic member and by means for inducing a magnetic field, wherein it also comprises a circular target partly located outside the cavity and rotating in a plane perpendicular to the that of the path of the electrons, the end of the target periodically traversing said path to periodically interact with the electrons on their circular path in order to produce bremsstrahlung and means for varying the magnetic field in the cavity, said means being synchronized with the interaction period of the target and the electrons and being connected to the magnetic induction means.

The means for varying the magnetic field in the cavity make it possible to vary said field in such a way that the electrons present in the cavity are periodically accelerated synchronously with the target-electron interaction. Therefore the bremsstrahlung obtained is substantially continuous.

Moreover, as the circular target is partly located outside the cavity, the cavity dimensions do not limit those of the target. Furthermore, advantageously, the target has a large diameter, particularly for producing high power bremsstrahlung.

Thus, in view of the fact that the energy of an electron beam interacting with a target is roughly 15% converted into radiant energy and the remainder into heat, the apparatus according to the invention preferably comprises means for cooling the target. These means become even more necessary as the power of the electron beam increases and the larger the surface of the target the better the cooling obtained. It is therefore advantageous to use a large diameter target, particularly for producing high power radiation.

Moreover, for obtaining high power radiation, the electron beam must also be a high power beam. However, the mean power of the electron beam is equal to the energy of the beam during an acceleration multiplied by the frequency of the accelerations, said frequency corresponding to the frequency of the target-electron interaction. Moreover, in order to have a high frequency of interactions and in order to obtain a high power electron beam, the tangential velocity V of the target must be high. Velocity V is a function of the target radius r and the normal acceleration A of the target in accordance with the euation $A=(V^2/r)$.

In view of the fact that the target acceleration A is limited by the mechanical behaviour of the material forming the target, particularly on its periphery, a large diameter target is used in order to have a high tangential rotation velocity of the target. For a given acceleration A, the larger the target diameter, the higher the tangential velocity of the target.

Thus, the use of a large diameter target makes it possible to bring about a good target cooling and a rotation of the target at a high tangential velocity. Therefore a large diameter target is advantageously used for producing high power radiation.

According to a preferred embodiment, the end of the target is formed from teeth regularly distributed over its entire periphery. These teeth can also be contained in the plane of the target and in a plane perpendicular or inclined with respect thereto. The tooth shape can be of a random nature. Thus, it is merely necessary to have a filiform material for interacting with the electrons. Moreover, the entire target or its teeth only are made from a heavy material, such as tantalum or tungsten.

Obviously, the target can also be constituted by a disk having holes regularly distributed over its periphery.

For example, for an apparatus according to the invention having a 50 cm diameter cavity within which the maximum magnetic induction on the orbit of the electrons is 0.14T and within the orbit 0.28 T, a bremsstrahlung of 7.5 kW is obtained from an electron beam with an acceleration frequency of 10 kHz and mean power 50 kW. This frequency of 10 kHz is obtained with a 1 m diameter target, whose end is formed from 10 mm teeth, spaced by 30 mm and having a tangential rotation velocity of 400 m/s. The width of the target teeth and the distance between them are in particular a function of the diameter of the electron beam.

According to a preferred embodiment of the invention, the target diameter exceeds the diameter of the path of the electrons.

As a function of the structure of the ferromagnetic member used and the diameter of the target, the latter can cut or intersect the ferromagnetic member and even be partly outside the latter. It is obviously easier to associate cooling means with the target when the latter is partly located outside the magnetic structure.

Advantageously the means for varying the magnetic field comprise means for detecting the target position with respect to the circular path of the electrons and means for processing the signals produced by the detection means, said processing means being connected on the one hand to the detection means and on the other hand to the magnetic induction means.

According to an embodiment of the detection means, they comprise a light source and a photoelectric detector located on either side of the plane formed by the target and facing the end thereof, said detector being connected to the processing means. For example, the light source is a diode and the photoelectric detector a phototransistor.

According to a variant of the embodiment of the detection means, they are made from a ferromagnetic material, such as iron deposited at the end of the target and a fixed magnetic circuit facing the end of the target, said magnetic circuit being connected to the processing means. The magnetic circuit advantageously comprises a U-shaped magnet and a solenoid around one of the U branches of said magnet, the solenoid being connected to the processing means.

Preferably, the processing means comprise means for generating successive sequences of parallel signals from the signals from the detection means and means for supplying the magnetic induction means from parallel signals, said supply means being connected on the one hand to the means for generating parallel signals and on the other hand to the magnetic induction means.

According to an embodiment, the magnetic induction means comprise at least one solenoid wound onto part of the ferromagnetic member, the supply means comprise four ransistors respectively connected to the means for generating the parallel signals, a first and a second transistors also being connected to one another and to a terminal of the solenoid and a third and fourth transistors are connected to one another and to the other terminal of the solenoid, the first and third transistors also being connected to a d.c. voltage power supply and the second and fourth transistors to ground.

According to a variant, the magnetic induction means comprise at least two solenoids separately wound onto part of the ferromagnetic member, the supply means comprise a first d.c. voltage power supply supplying the first solenoid, a second d.c. voltage power supply connected to the centre of the second solenoid and two asemblies of at least one transistor respectively connected to the means for generating parallel signals, to a separate terminal of the second solenoid and to ground.

The invention also relates a process for producing bremsstrahlung by the interaction of electrons with a target of an apparatus like that described hereinbefore. This process is characterized in that periodic induction takes place in the cavity of a magnetic field which is constant at least during the interaction between the electrons and the target, decreasing after the interaction and then increasing before the interaction.

BRIEF DESCRIPTION OF THE DRAWINGS

The invention is described in greater detail hereinafter relative to non-limitative embodiments and the attached drawings, wherein show:

FIG. 3, diagrammatically an embodiment of an apparatus according to the invention.

FIG. 4, diagrammatically an example of means for cooling the target.

DETAILED DESCRIPTION OF THE PREFERRED EMBODIMENTS

Figure 1:
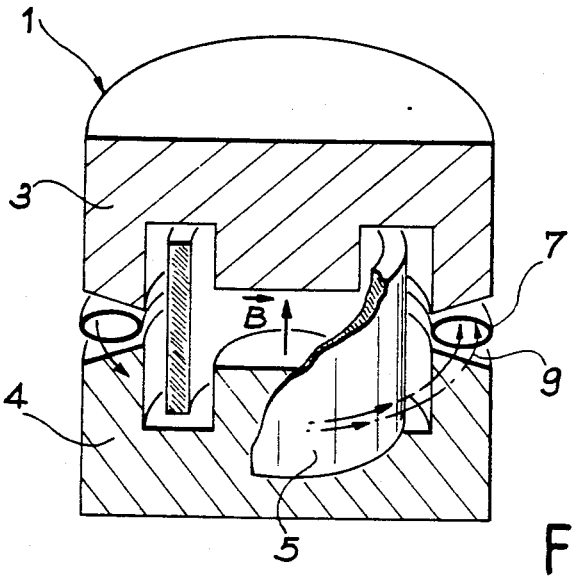
FIG. 1 PRIOR ART
FIG. 1, already described, diagrammatically and in section the structure of a conventional electron accelerator.
Figure 2:
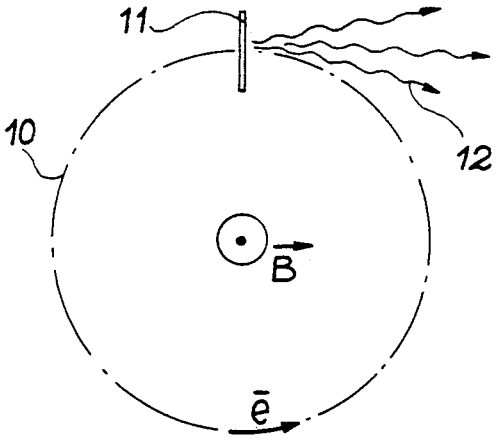
FIG. 2 PRIOR ART
FIG. 2, already described, diagrammatically the interaction between electrons and a target placed on the circular path of these electrons.

FIG. 3 diagrammatically shows an apparatus according to the invention. This apparatus comprises a ferromagnetic member 20 constituted by eight separate elements 21, which are combined with one another so as to form a cross, each branch of the cross being formed by two of these elements.

In the centre of the ferromagnetic member 20 and in the plane of the cross is located a circular cavity 25 with a conical end 26. This cavity is not closed and has openings 28 on the sides of the branches of the cross. Means for inducing a magnetic field, such as solenoids 47 are wound onto part of the facing elements 21 of the cavity.

When a magnetic field is induced in the cavity by the ferromagnetic member and solenoids 47, in a direction perpendicular to the plane of the cross, the electrons present in the cavity are rotated on a circular path or trajectory 24 located in a plane perpendicular to the magnetic field direction.

This apparatus also comprises a circular target 23, e.g. made from tantalum or tungsten and located between two elements of a branch of the cross, as a result of a slight indentation made in these elements for receiving the target. This target is rotated in a plane perpendicular to that of the electron path 24.

This target is provided at its ends with teeth 27 regularly distributed over the target periphery. These targets periodically traverse the trajectory of the electrons and consequently periodically interact with said electrons. The electron-target interaction leads to the emission of bremsstrahlung (not shown in this drawing), which escapes tangentially to path 24 by the openings 28 in the cavity.

The assembly formed by the ferromagnetic member 20 and target 23 shown in this drawing is placed in a not shown vacuum enclosure, so as not to distrub the movement of the electrons and the electron-target interaction.

For example, the ferromagnetic member used can have a height of 40 cm and a length of 76 cm. Moreover, the circular cavity and the target respectively have e.g. a diameter of 50 cm and 1 m.

As shown in FIG. 3, the target intersects the ferromagnetic member and part of the target is outside the ferromagnetic member and therefore the magnetic structure.

The ferromagnetic member 20 in FIG. 3 is shaped like a cross, but could have any other random shape. Moreover, the end of the cavity is conical for energy dissipation reasons, but any other divergent shape could be used.

As in the case of modified betatrons, a not shown toroidal coil can be disposed in cavity 25, in such a way that the circular path 24 of the electrons traverses said coil. As has been shown hereinbefore, this coil, to whose terminals a voltage is applied, makes it possible to focus the electron beam.

The velocity of the electrons on path 24 is dependent on the magnetic field induced in the cavity. According to the invention, the magnetic field in the cavity is varied in such a way that it increases before each interaction of the electrons with a tooth 27 on the target 23. During this interaction, the magnetic field must be constant and the electrons are stopped by the target. After each interaction, the magnetic field is decreased in order to eliminate any magnetic induction in the cavity, so as to permit a further increase in the magnetic field and therefore a further electron-target interaction. This decrease or decay of the field can take place both at the end of the passage of a tooth in path 24 and at the start of the passage through the trajectory by the space located between two teeth. In order to vary the value of the magnetic field, designated $B_m(t)$, induced in the cavity, the voltage applied to the terminals of solenoids 47 is varied.

In order to obtain continuous sequences in which field $B_m(t)$ is successively rising, constant and decaying, in accordance with the position of teeth 27 of the target on electron path 24, use is made of means for detecting the position of the teeth and processing means connected to the detection means and to the solenoids 47.

As was stated hereinabove, the apparatus according to the invention advantageously has means for cooling the target.

FIG. 4 diagrammatically shows in section an embodiment of the means for cooling target 23. In this case, target 23 is hollow and the cooling means comprise a disk **23*a* located within and in the centre of target 23, a pipe 23*b* for supplying a cooling liquid 22 and a pipe 23*c* for discharging the cooling liquid positioned within the axis of the target on either side thereof. Disk 23*a*** is fixed to the target axis.

When the cooling liquid from pipe **23*b* enters target 23, it spreads out within the latter between the target wall 23*x* closest to pipe 23*b* and disk 23*a*. It then passes from the other side of disk 23*a* and spreads out between the other face of the disk and the target wall 23*z* closest to pipe 23*c*. The liquid then passes out through pipe 23*c* after being heated on the target walls. Preferably, wall 23*x*** corresponds to the wall which interacts with the electrons.

Obviously, the apparatus according to the invention can have other means for cooling the target, such as e.g. those described in U.S. Pat. No. 4,165,472.

Figure 5:
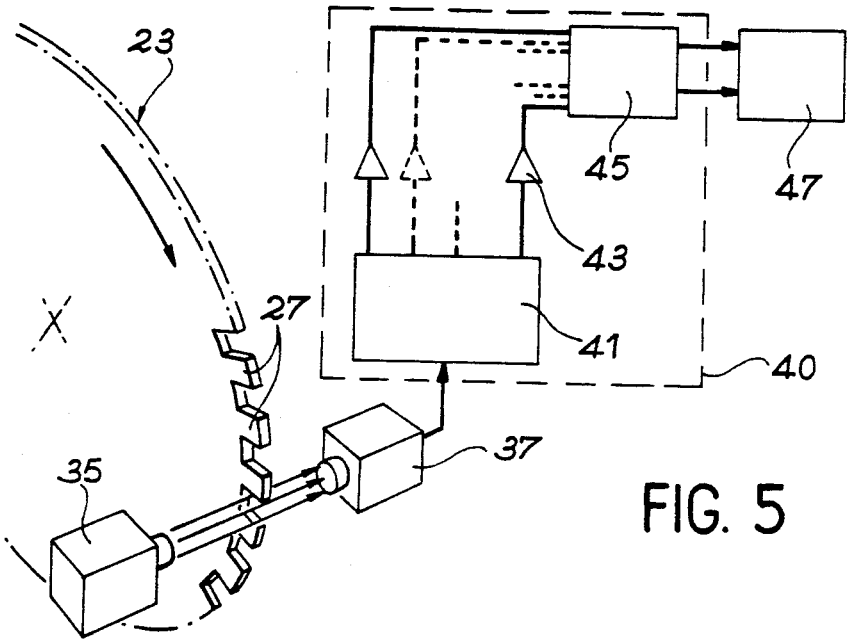
FIG. 5, diagrammatically an embodiment of means for varying the magnetic field incorporating optoelectronic detection means.

FIG. 5 shows an embodiment of the detection means associated with processing means. These detection means comprise a light source 35, such as a diode and a photoelectric detector 37, such as a phototransistor. Source 35 and detector 37 are placed on either side of target 23 facing the end of the latter. Moreover, detector 37 is connected to the processing means 40, which are themselves connected to magnetic induction means 47, such as solenoids.

Processing means 40 comprise means 41 for generating successive sequences of parallel sequential signals as from the signals from the detector 37. Means 40 also have means 45 for supplying means 47 as a function of the parallel signals from means 41 and which are generally amplified by amplifiers 43.

The signals generated by detector 37 are constituted by a sequence of periodic pulses, each rising front of a pulse corresponding to the passage of light from source 35 to the detector and each falling front corresponding to the stopping of the light by a tooth 27 of the target.

Means 41 are constituted by any known means, such as a sequencer, making it possible to initiate sequences of parallel sequential signals on a rising or falling front of signals generated by the detector. If the detection means 35, 37 are positioned facing the teeth of the target at each electron-target interaction, means 41 must exert an initiating action on a falling front. However, if means 35, 37 are positioned facing the space between two teeth of the target at each interaction, means 41 must have an initiating effect on rising front.

Examples of means 45 for supplying the magnetic induction mens 47 and examples of parallel signals applied to said means 45 will be described with reference to FIGS. 7, 8, 9 and 10.

Figure 6:
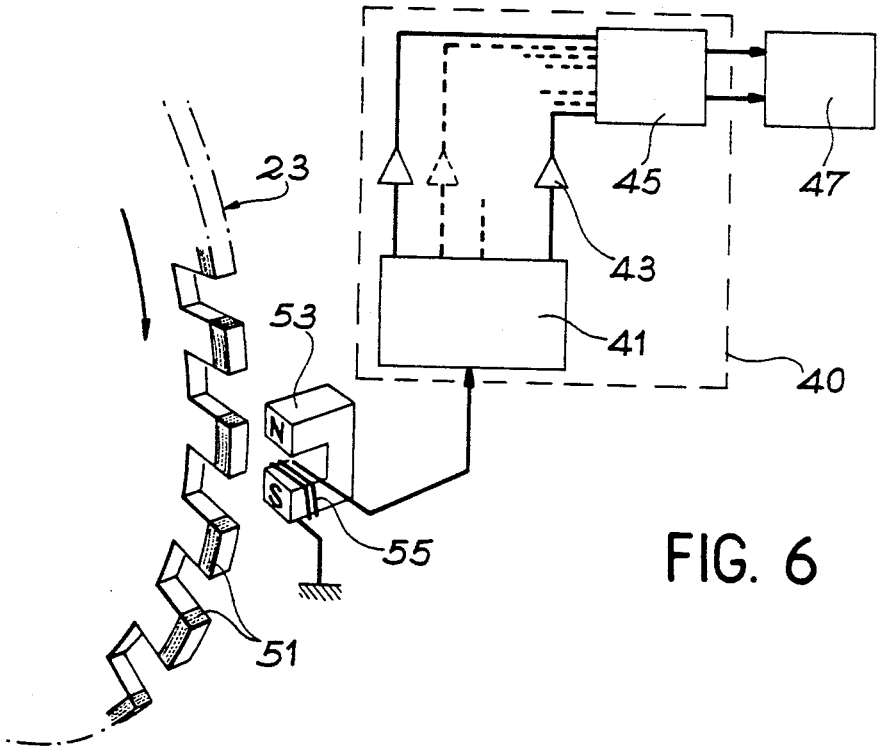
FIG. 6, diagrammatically another embodiment of the means for varying the magnetic field and incorporating magnetic detection means.

FIG. 6 shows another embodiment of the detection means, which are also connected to the processing means 40, themselves connected to the magnetic induction means 47.

These detection means are made from a ferromagnetic material 51, such as iron located at the end of each tooth 27 of target 23 and a magnetic circuit facing the target end. This magnetic circuit e.g. has a U-shaped magnet 53, onto one branch of which is wound a solenoid 55. The solenoid terminals are respectively connected to the processing means 40 and to ground. The magnetic circuit 53, 55 and the ferromagnetic material 51 can both be in the plane of the target and in a random plane as from the time when a tooth of the target passes in the vicinity of the magnetic circuit, material 51 and magnet 55 forming a closed magnetic circuit.

Thus, during the rotation of the target, the reluctance of the magnetic circuit varies as a function of the extent to which the material 51 deposited on the teeth closes the circuit. Thus, the resulting voltage at the terminals of solenoid 55 has successive rising and falling fronts, a rising front corresponding to the passage of a tooth in front of magnet 55 and a falling front corresponding to a space between two teeth passing in front of magnet 53.

As hereinbefore, the sequencer of means 40 must initiate each sequence of parallel signals either on a rising front, or on a falling front, as a function of whether said fronts do or do not correspond to the passage of a tooth in the path 24 of the electrons.

Figure 7:
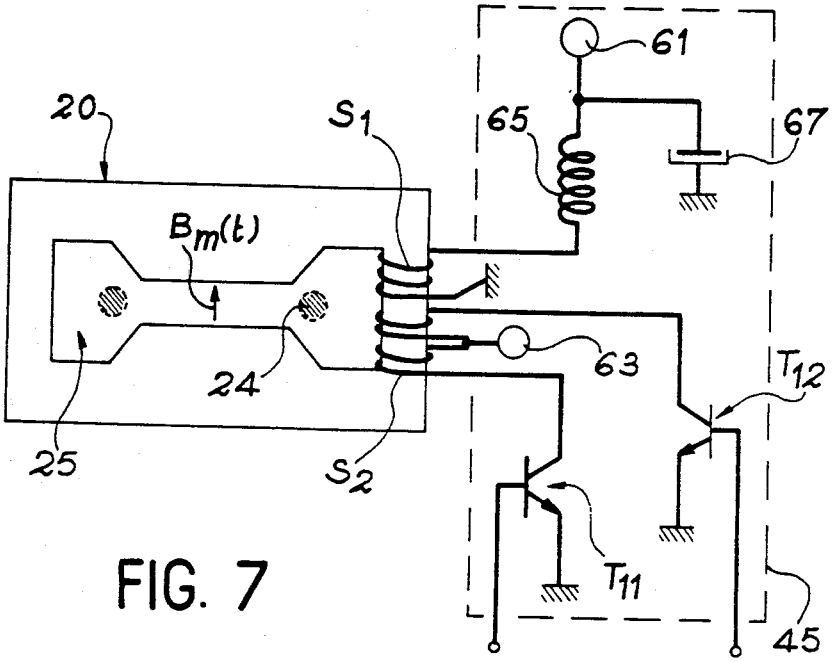
FIG. 7, diagrammatically an embodiment of the magnetic induction means associated with the supply means.

FIG. 7 shows an embodiment of the supply means 45 for the magnetic induction means 47. FIG. 7 shows in section the ferromagnetic member 20 within which is located circular cavity 25. Two separate solenoids $S_1$ and $S_2$ are wound onto the end of the ferromagnetic member facing the cavity. These solenoids form the magnetic induction means 47. The terminals of solenoid $S_1$ are respectively connected to a d.c. voltage power supply 61 and to ground. The terminals of solenoid $S_2$ are respectively connected to transistors $T_{11}$ and $T_{12}$ and the centre of the solenoid to a d.c. voltage power supply 63. In this embodiment, magnetic field $B_m(t)$ is the superimposition of two magnetic fields $B_{s1}$ and $B_{s2}(t)$.

The first field $B_{s1}$ is constant and is induced by the ferromagnetic member and by solenoid $S_1$ supplied by a d.c. voltage across a choke or inductor 65, in such a way that the field $B_{s1}$ is of value $B_o$. This d.c. voltage is generated by the power supply 61. The function of the choke is to absorb the a.c. voltage induced by variations in field $B_m(t)$ at the terminals of $S_1$. Moreover, a capacitor 67 connected on the one hand between the power supply 61 and choke 65 and on the other hand to ground makes it possible to protect power supply 61. the second field $B_{s2}$ (t) is variable and is induced by the ferromagnetic member and by the solenoid $S_2$, whose centre is supplied by a d.c. voltage $V_1$ from power supply 63 and whose terminals respectively pass to the collectors of transistors $T_{11}$ and $T_{12}$. Moreover, the emitters of transistors $T_{11}$ and $T_{12}$ are connected to ground and the bases of said transistors are respectively connected to a sequencer 41 of the type described hereinbefore supplying parallel sequential signals synchronized with the position of the rotary target 23.

Figure 8:
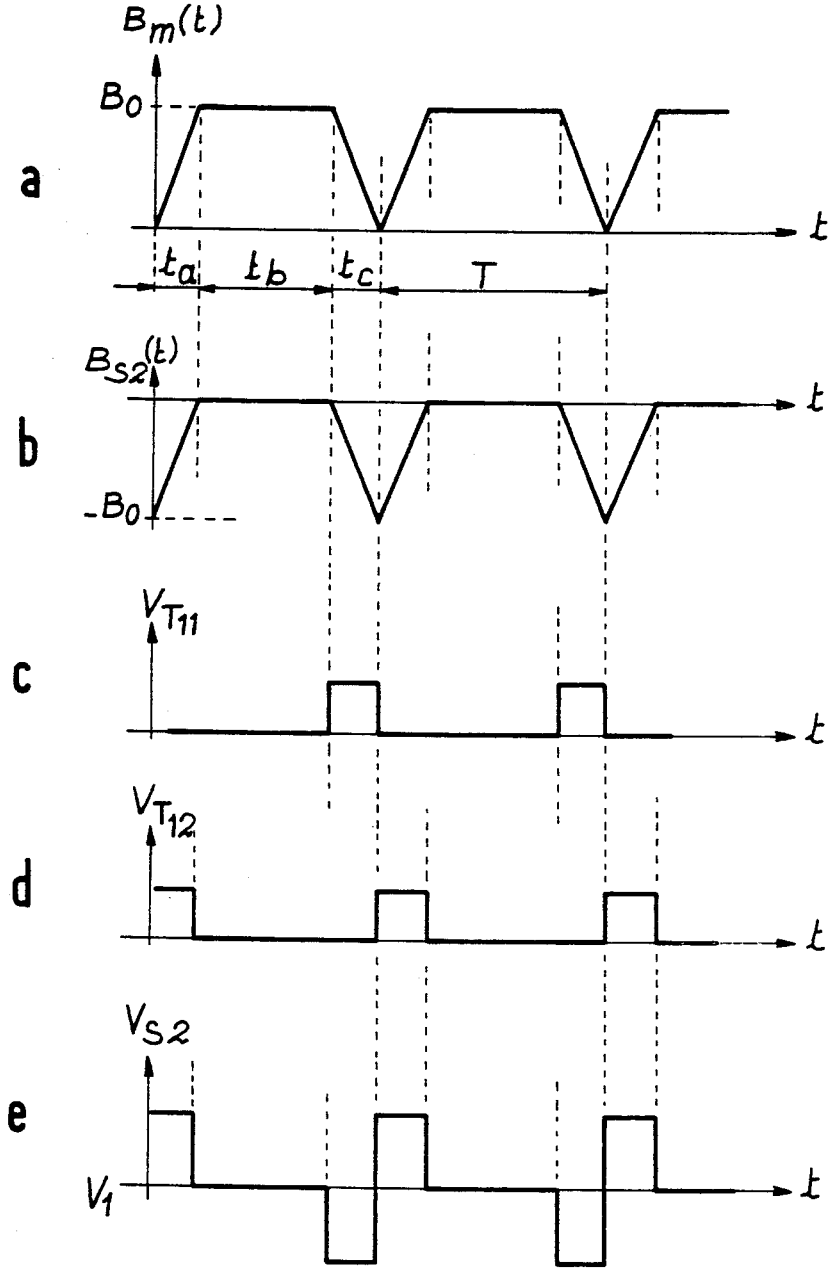
FIG. 8, the most important timing diagrams of the means shown in FIG. 7.

For a supply circuit like that shown in FIG. 7, the sequencer supplies two parallel signals $V_{T11}$ and $V_{T12}$, which act on the bases respectively of transistors $T_{11}$ and $T_{12}$. Such signals are shown in FIG. 8 (c, d). Transistor $T_{11}$ or $T_{12}$ is in the on state when signal $V_{T11}$ or $V_{T12}$ is not zero. The resulting voltage $V_{S2}$ at the terminals of solenoid $S_2$ is shown at e in FIG. 8. This voltage $V_{S2}$ fluctuates around the voltage $V_1$: $V_{S2}$ being below $V_1$ when $V_{T11}$ is not zero, $V_{S2}$ exceeding $V_{S1}$ when $V_{T12}$ is not zero and $V_{S2}$ is equal to $V_1$ when $V_{T11}$ and $V_{T12}$ are zero. The value of voltage $V_1$ is chosen in such a way that the magnetic field $B_{S2}$ (t) induced by the ferromagnetic member and by solenoid $S_2$ (FIG. 8, b) varies in time between the value $-Bo$ and a zero value. Thus, field $B_{S2}(t)$ increases when the voltage $V_{S2}$ exceeds $V_1$, is zero when voltage $V_{S2}$ is equal to $V_1$ and decreases when voltage $V_{S2}$ is below $V_1$.

The resulting field $B_m(t)$ in the cavity (FIG. 8, a) is the superimposition of field $B_{S1}$ and field $B_{S2}$ (t) and undergoes the same variations as field $B_{S2}$ (t). In the case shown in FIGS. 7 and 8, field $B_m(t)$ is positive and field $B_s$ (t) negative, but the reverse is obviously all possible.

The time $t_b$ during which the field $B_m(t)$ is constant corresponds to the maximum time during which the electrons interact with a tooth of the target, the field decay time $t_c$ can take place both at the end of the passage of path by the tooth and at the start of the passage of the path by a space between two teeth. However, the field rise time $t_a$ takes place during the passage of the path by a space between two teeth.

In the case of a target interacting every $10^{-4}$ s with the electrons, the period T of the variation of field $B_m(t)$ is equal to $T=10^{-4}$ s. Under these conditions, a choice is made of the times $t_a=25$ μs, $t_b=50$ μs and $t_c=25$ μs. Between the times $t_c$ and $t_a$, there can be a dead time.

The width of each tooth and the space between two teeth are calculated as a function of the times $t_a$, $t_b$ and $t_c$ necessary for obtaining a substantially constant bremsstrahlung. For these times, the width of each tooth is e.g. equal to 10 mm and the space between two teeth to 30 mm.

As shown in FIG. 8, transistors $T_{11}$ and $T_{12}$ are only conductive during a small part of the period T respectively corresponding to times $t_c$ and $t_a$. This has the advantage of limiting the power that the transistors must dissipate and therefore increases the overall efficiency of the apparatus. Moreover, the power levels required for the operation of the apparatus according to the invention are very high, so that it is advantageous to arrange a large number of transistors in parallel respectively with $T_{11}$ and $T_{12}$.

Moreover, so as not to have to associate with these transistor groups balancing circuits, which generally consume a large amount of power, it is possible to use the same number of solenoids $S_2$ as there are transistors in parallel with transistors $T_{11}$, $T_{12}$, each solenoid being connected by its terminals to a transistor in parallel with $T_{11}$ and a transistor in parallel with $T_{12}$. These solenoids are wound facing the cavity 25, e.g. on part of each element 21 of ferromagnetic member 20.

Figure 9:
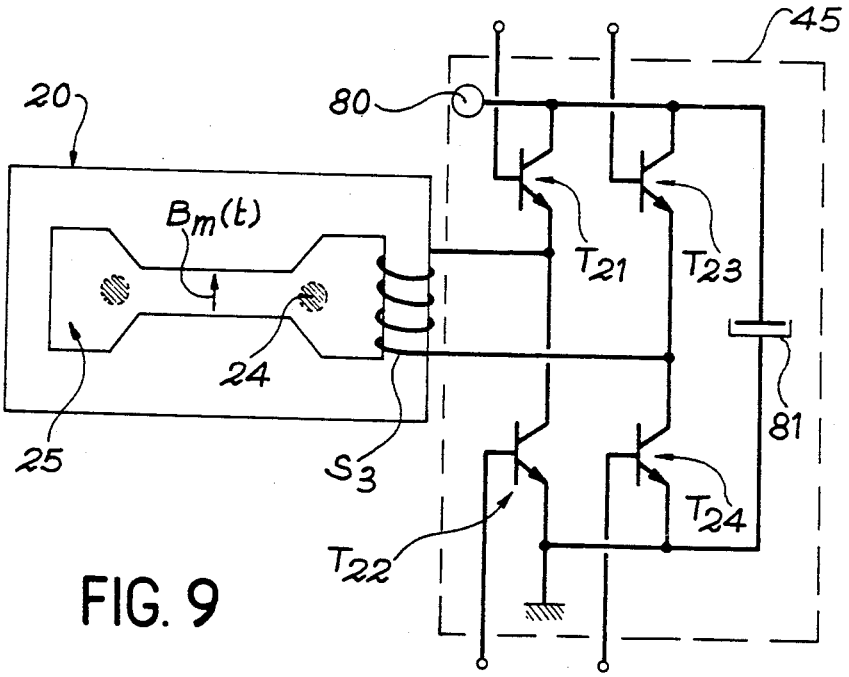
FIG. 9, diagrammatically another embodiment of magnetic induction means associated with the supply means.

FIG. 9 shows another embodiment of the means 45 for supplying the magnetic induction means 47. Means 47 comprise a solenoid $S_3$ wound onto part of the ferromagnetic member 20 facing cavity 25. Means 45 comprise four transistors $T_{21}$, $T_{22}$, $T_{23}$ and $T_{24}$ connected by their base to a sequencer 41 of the type described hereinbefore and acting on the basis of said transistors respectively by four parallel signals.

Transistor $T_{21}$ is also connected by its collector to a d.c. power supply 80 and by its emitter to the collector of transistor $T_{22}$ and to a terminal of solenoid $S_3$, the emitter of transistor $T_{22}$ also being connected to ground.

Transistor $T_{23}$ is also connected by its collector to the power supply 80 and by its emitter to the collector of transistor $T_{24}$ and to the other terminal of solenoid $S_3$, the emitter of transistor $T_{24}$ also being connected to ground. A capacitor 81 connected in parallel with transistors $T_{21}$, $T_{22}$ and $T_{23}$, $T_{24}$ makes it possible to protect the d.c. voltage power supply.

Power supply 80 supplies a voltage $V_1$ such that the field $B_m$ (t) induced by the ferromagnetic member and solenoid $S_3$ varies between the value $+B_o$ and zero.

Figure 10:
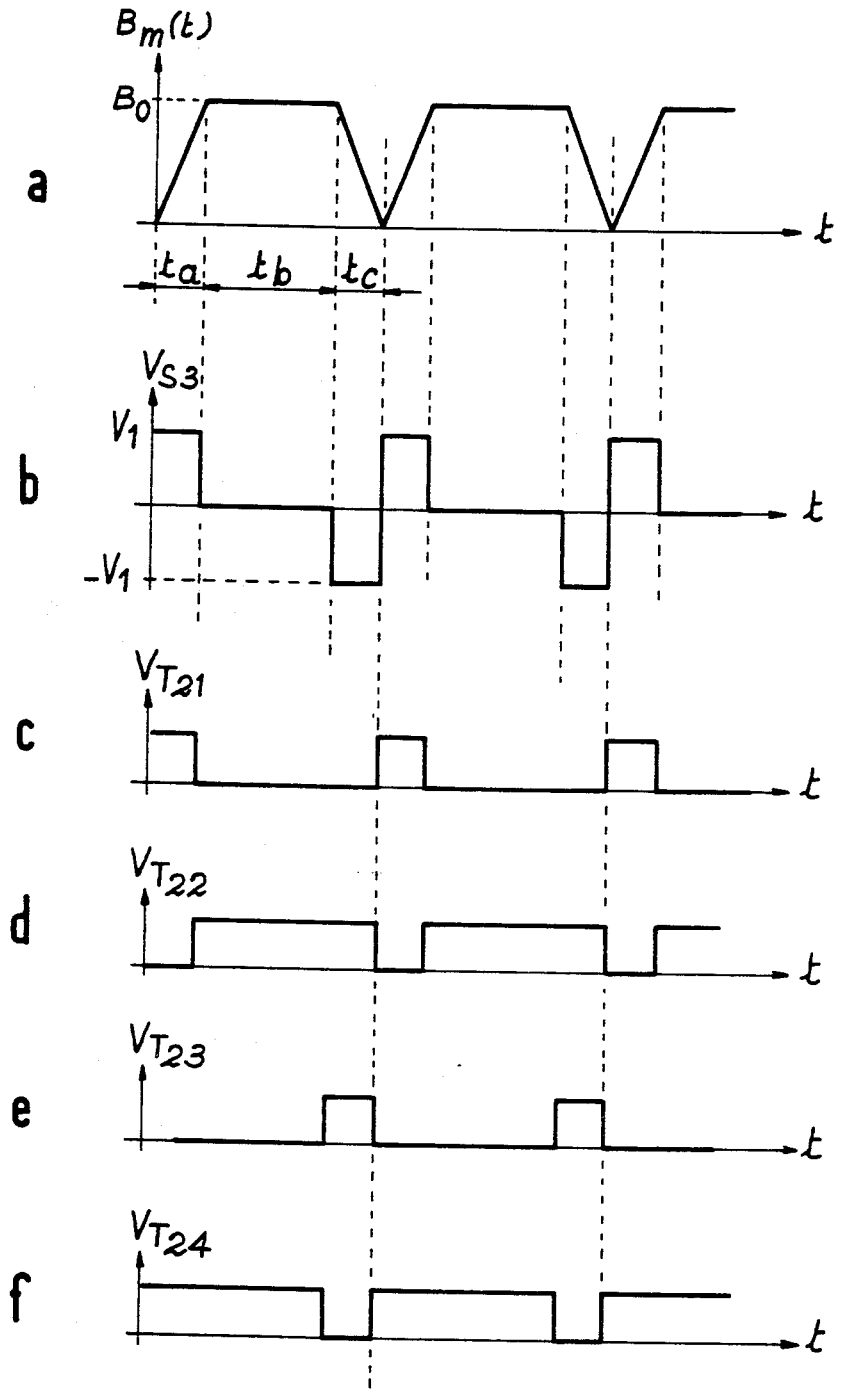
FIG. 10, the main timing diagrams of the means shown in FIG. 9.

The parallel signals $V_{T21}$, $V_{T22}$, $V_{T23}$ and $V_{T24}$ applied by the sequencer to each of the bases of transistors $T_{21}$, $T_{22}$, $T_{23}$ and $T_{24}$ are respectively represented at c, d, e and f in FIG. 10. Signals $V_{T21}$ and $V_{T22}$, as well as signals $V_{T23}$ and $V_{T24}$ are complementary. Thus, when $V_{T21}$ (respectively $V_{T23}$) is zero, $V_{T22}$ (respectively $V_{T24}$) is not zero and vice-versa. Therefore when transistors $T_{21}$ and $T_{24}$ are conductive (during time $t_a$), transistors $T_{22}$ and $T_{23}$ do not conduct and the voltage $V_{S3}$ at the terminals of solenoid $S_3$(b, FIG. 10) is positive ($+V_1$). When transistors $T_{22}$ and $T_{23}$ conduct (during time $t_c$), transistors $T_{21}$ and $T_{24}$ do not conduct and the voltage $V_{S3}$ is negative ($-V_1$). Finally, when transistors $T_{22}$ and $T_{24}$ conduct (during time $t_b$), transistors $T_{21}$ and $T_{23}$ do not conduct and the voltage $V_{S3}$ is zero. The voltage $V_{S3}$ at the terminals of solenoid $S_3$ consequently varies between $V_1$ and $-V_1$ and the resulting magnetic field $B_m(t)$ in the cavity (a, FIG. 10) has the same configuration as that described at a in FIG. 8 and varies between the value $+B_o$ and zero.

To reduce the voltage to be applied to each transistor, as described hereinbefore, it is advantageous to subdivide solenoid $S_3$ into several solenoids, the terminal thereof being respectively connected between transistors $T_{21}$ and $T_{22}$ and between transistors $T_{23}$ and $T_{24}$. The different solenoids are e.g. constituted by eight solenoids 47 wound onto each element 21 of member 20 by a single turn and as shown in FIG. 3.

Modifications to the different means described with reference to FIGS. 3 to 10 can be envisaged without passing outside the scope of the invention. It is in particular possible to use other supply means making it possible to obtain voltages of type $V_{S2}$ and $V_{S3}$ and this also applies with regards to the detection means.

What is claimed is:

1. An apparatus for producing bremsstrahlung X-rays or gamma-rays comprising a ferromagnetic member having a cavity containing electrons rotated on a circular path under the action of a magnetic field, a means for inducing a magnetic field in said cavity a sustantially circular target partly located outside the cavity and rotating in a plane perpendicular to the path of the electrons, said target having an uneven periphery which during rotation causes the target to periodically traverse the circular electron path and to periodically interact with the electrons on their circular path, the interaction producing premsstrahlung X-rays or gamma-rays, and means for varying the magnetic field in the cavity, said varying means being synchronized with the interaction period of the target and the electrons and being connected to the means for inducing a magnetic field.

2. An apparatus according to claim 1, said target further comprising cooling means disposed within said target for removing thermal energy resulting from said interaction.

3. An apparatus according to claim 1, wherein the target diameter is larger than the diameter of the path of the electrons.

4. An apparatus according to claim 1, wherein the target intersects the ferromagnetic member.

5. An apparatus according to claim 1, wherein said uneven periphery of the target is formed from teeth regularly distributed over its entire periphery.

6. An apparatus according to claim 1, wherein the means for varying the magnetic field comprise means for detecting the position of the target with respect to the circular path of the electrons and means for processing the signals produced by the detecting means, said processing means being electrically connected on the one hand to the detecting means and on the other hand to the means for inducing the magnetic field.

7. An apparatus according to claim 6, wherein the detecting means comprise a light source and a photoelectric detector disposed on either side of the plane formed by the target and facing the periphery of the target, said detector being connected to the processing means.

8. An apparatus according to claim 6, wherein the detecting means comprise a ferromagnetic material deposited at the end of the target and a fixed magnetic circuit positioned facing the periphery of the target, said magnetic circuit being connected to the processing means.

9. An apparatus according to claim 8 wherein the magnetic circuit comprises a U-shaped magnet and a solenoid wound around one U branch of said magnet, the solenoid being connected to the processing means.

10. An apparatus according to claim 6, wherein the processing means comprise means for generating successive sequences of parallel signals from the signals coming from the detecting means and means for supplying the means for inducing the magnetic field from the parallel signals, said supplying means being connected on the one hand to the means for generating parallel signals and on the other hand to the means for inducing the magnetic field.

11. An apparatus according to claim 10, wherein the means for inducing the magnetic field comprise at least one solenoid wound onto part of the ferromagnetic member, the supply means comprise four transistors respectively connected to the means for generating the parallel signals, a first and a second transistor also being connected to one another and to a terminal of the solenoid and a third and fourth transistors are connected to one another and to the other terminal of the solenoid, the first and third transistors also being connected to a d.c. voltage power supply and the second and fourth transistors to ground.

12. An apparatus according to claim 10, wherein the means for inducing the magnetic field comprise at least two solenoids separately wound onto component portions of the ferromagnetic member, the supply means comprise a first d.c. voltage power supply supplying the first solenoid, a second d.c. voltage power supply connected to the center of the second solenoid and two assemblies of at least one transistor respectively connected to the means for generating parallel signals, to a separate terminal of the second solenoid and to ground.

13. In a process for the production of bremsstrahlung x-rays or gamma-rays by the intermittent interaction of electrons rotated in a cavity of a ferromagnetic member with a target comprising inducing a magnetic field in the cavity of the ferromagnetic member, rotating the target in a plane in the path of the electrons to produce the bremsstrahlung x-rays or gamma-rays, maintaining the magnetic field constant at least during successive interaction periods between the electrons and the target, decreasing the magnetic field after each interaction period and increasing the magnetic field before each interaction period.

14. A process according to claim 13 including rotating an uneven surface target in a plane in the path of the electrons to produce the bremsstrahlung x-rays or gamma-rays.

15. A process according to claim 13 including periodically traversing the electrons with the target to effect a periodic interaction of the electrons with the circular path to produce the bremsstrahlung x-ray or gamma-rays.

16. A process according to claim 13 wherein the plane is perpendicular to the path of electrons.

17. A process according to claim 14 wherein the plane is perpendicular to the path of electrons.

* * * * *

UNITED STATES PATENT AND TRADEMARK OFFICE

CERTIFICATE OF CORRECTION

PATENT NO. : 4,845,732

DATED : July 4, 1989

INVENTOR(S) : ROCHE, Michel

It is certified that error appears in the above-identified patent and that said Letters Patent is hereby corrected as shown below:

Col. 10, Claim 1, line 1, "premsstrahlung" should be --bremsstrahlung--.

Signed and Sealed this

Fifteenth Day of May, 1990

*Attest:*

HARRY F. MANBECK, JR.

*Attesting Officer*

*Commissioner of Patents and Trademarks*